US005462831A

United States Patent [19]

Jansen et al.

[11] Patent Number: 5,462,831

[45] Date of Patent: Oct. 31, 1995

[54] PROCESSING OF SILVER HALIDE PHOTOGRAPHIC INDUSTRIAL X-RAY FILMS

[75] Inventors: Benedictus Jansen, Geel; André Roefs, Kasterlee; Francis Sels, Kontich; Pieter Perdieus, O.L.V. Waver; Raymond Florens, Edegem, all of Belgium

[73] Assignee: Agfa-Gevaert, N.V., Mortsel, Belgium

[21] Appl. No.: 223,426

[22] Filed: Apr. 5, 1994

[30] Foreign Application Priority Data

Apr. 13, 1993 [EP] European Pat. Off. ..... 93201074

[51] Int. Cl.[6] ..... G03C 5/16

[52] U.S. Cl. ..... 430/139; 430/502; 430/966; 430/523; 430/527; 430/434; 430/435; 430/488; 430/961; 430/444

[58] Field of Search ..... 430/139, 502, 430/966, 523, 527, 434, 435, 444, 488, 961

[56] References Cited

U.S. PATENT DOCUMENTS

| | | | |
|---|---|---|---|
| 4,623,615 | 11/1986 | Yokoyama et al. | 430/527 |
| 4,624,913 | 11/1986 | Miyasaka et al. | 430/444 |
| 4,880,725 | 11/1989 | Hirai et al. | 430/373 |
| 4,891,307 | 1/1990 | Mukunoki et al. | 430/527 |
| 4,956,270 | 9/1990 | Tachibana | 430/527 |
| 5,187,054 | 2/1993 | Dewanckele et al. | 430/523 |
| 5,250,402 | 10/1993 | Okada et al. | 430/460 |
| 5,258,275 | 11/1993 | Arai et al. | 430/523 |
| 5,292,626 | 3/1994 | Buhr et al. | 430/331 |

FOREIGN PATENT DOCUMENTS

| | | | |
|---|---|---|---|
| 0538947 | 4/1993 | European Pat. Off. . | |
| 3002750 | 1/1991 | Japan | 430/488 |
| 5232653 | 9/1993 | Japan | 430/488 |

*Primary Examiner*—Thomas R. Neville
*Attorney, Agent, or Firm*—Breiner & Breiner

[57] ABSTRACT

To eliminate the "pi-line" artifact after processing a method of image formation is disclosed in a silver halide industrial X-ray photographic material, comprising on at least one side of a support, at least one gelatin silver halide emulsion layer and a total amount of silver halide, corresponding to from 6 to 20 g of silver nitrate per square meter and per side, and at least one non-sensitive protective antistress coating, wherein said material further comprises a hardening agent different from a vinyl sulphone compound, preferably formaldehyde, and at least one polyoxyalkylene compound as a surfactant in at least one of its hydrophilic layers, and wherein after exposure to direct X-rays said material is subjected in an automatic processing machine to the steps of developing in a developer comprising at least one anionic alkylphenoxy polyalkyleneoxy phosphate ester surfactant, fixing in a fixer which may comprise at least one alpha-ketocarboxylic acid, rinsing and drying.

10 Claims, No Drawings

PROCESSING OF SILVER HALIDE PHOTOGRAPHIC INDUSTRIAL X-RAY FILMS

DESCRIPTION

1. Field of the Invention

This invention relates to an image forming method for a silver halide photographic industrial X-ray film by the processing of said exposed film in automatic processing machines.

2. Background of the Invention

For industrial radiography a normal processing cycle is characterized by the following steps: transport of the film through the developer at 28° C., transport through the fixer at 26° C., transport through a rinsing bath and transport through the drying station. If an automatic processing machine is used film transport is made possible by the racks each of which is provided with a lot of rollers immersed in the different processing baths. Due to the normal use of this automatic processing machine the said different processing baths become inevitably polluted by e.g. dust being carried into the processor by the film to be processed itself. Another possibility consists in the generation of very small metallic silver particles in the developer, due to the development process. Inevitably quite a lot of manipulations like an arrest in development, the start of the circulation of processing and regeneration liquids make the generated solid particles become deposited onto the rollers of the racks.

When a film is introduced into the processor as first film of a whole series of films, its first contact with the first stained roller releases the deposit from the said roller or disturbs the deposited layer. As a consequence after one rotation of the said roller the unevenly distributed dirt or stain comes into contact again with the transported film surface so that it may be deposited onto said surface. This phenomenon is recurrently repeated, not only at the first roller, but also at the further rollers that are mounted onto the racks.

The result of this process is that one or more visibly appearing disturbing lines may be observed at the surface of the processed film. This artefact is called "pi-line" as it is recurrently depicted at a distance corresponding to the circumference of the rollers. As the processing is further continuing the artefact may disappear.

The gravity of the said artefact is strongly dependant on the maintenance of the processor and on the silver content of the film. Strongly polluted processors may show many "pi-lines" at one or more successive film sheets when the said processors are started up.

The "pi-line" phenomenon, in some references also called "pie line", has already been described in "Radiographic Artefacts" by Richard J. Sweeney, Ed. J.B. Lippincott Co., Philadelphia, 1983, ISBN 0-397-50554, p. 288 and in "Radiographic Imaging" by Derrick P. Roberts & Nigel L. Smith, Ed. Churchill Livingstone, Edinburgh, 1988, ISBN 0-443-03061-8, p. 162.

From the patent literature it is well-known that the addition of several different additives to the developer as well as to the fixer have been proposed. U.S. Pat. No. 3,515,556 suggests the addition of a mixture of copolymers of catechine and leucocyanidine to the developer or to the fixer. U.S. Pat. No. 4,310,622 looks for a solution of "stripe silver contamination", to be interpretable as "pi-line", by means of the addition of a sulphonated benzimidazole compound.

TETENAL is offering since quite a lot of years an additive comprising a disulphide containing compound as an active substance therein.

The reduction of silver sludge in processing baths has further been described in U.S. Pat. No. 4,141,734 by Ciba-Geigy, which firm has published the use of these products under the trade name IRGAFORM 1007.

The addition to the developer of a lot of different heterocyclic mercapto compounds and a phosphate ester surfactant has been proposed in EP 223 883.

A more mechanical solution for this problem has been proposed in U.S. Pat. No. 4,853,728 wherein an optimization of the roller configuration of the racks prevents the occurrence of "pi-lines". Otherwise in the processors KODAK MODEL B, trade name product from Eastman Kodak and STRUCTURIX NDT-3, trade name product from Agfa-Gevaert, brush rollers installed at the end of the water rinsing station make the artefact to be removed mechanically before introduction into the drying station.

Another attempt has been made in EP-A 518 627 by coating the silver halide photographic material to be processed with a particulate wax dispersed in a hydrophilic colloid and wherein development proceeds about as described in EP 223 883, mentioned hereinbefore.

Nevertheless the proposed solutions are insufficient, especially for films with a high coating amount of silver, like industrial X-ray films where the appearance of one or more "pi-lines" may be intolerable as the detection of defects in e.g. weldings from pipe-lines or nuclear application may be covered and thus hidden by the said "pi-lines". Even mechanical means as brush rollers are not able to remove all of the deposit and have frequently to be replaced by new ones. Also from an economical point of view the additional costs resulting therefrom are intolerable. Otherwise additives to the developer not only show an insufficient removal of the artefact, but some of them cause an unpleasant smell and the formation of scum.

OBJECTS OF THE INVENTION

It is an object of the present invention to provide a method of processing an industrial X-ray film in automatical processing machines, thereby eliminating the "pi-line" artefact after processing of the said industrial X-ray films in processing solutions without scum or smell hindrance, and even without the need for the use of mechanical means as e.g. brush rollers.

Further objects will become apparent from the description hereinafter.

SUMMARY OF THE INVENTION

A method of image formation in a silver halide industrial X-ray photographic material is disclosed, wherein said material comprises on at least one side of a support, at least one gelatino silver halide emulsion layer and a total amount of silver halide, corresponding to from 6 to 20 g of silver nitrate per square meter and per side, and at least one non-sensitive protective antistress coating and wherein said method proceeds by the steps of exposing said material to direct X-rays and processing the material in an automatic processing machine by development, fixing, rinsing and drying, characterised in that said material further comprises at least one hardening agent different from a vinyl sulphone compound and at least one polyoxyalkylene compound in at least one of its hydrophilic layers, and that development occurs in a developer comprising as a surfactant at least one anionic alkylphenoxy and/or alkoxy polyalkyleneoxy phosphate ester, sulphate ester, alkyl carboxylic, sulphonic or phosphonic acid and/or a salt thereof and that fixing occurs in a fixer which may comprise at least one alpha-ketocarboxylic acid.

DETAILED DESCRIPTION OF THE INVENTION

According to the present invention an improved image without "pi-line" defects can be obtained on processing a silver halide industrial photographic X-ray material when said material comprises hardening agents differing from hardening agents of the vinyl sulphonyl type and at least one alkyleneoxide polymer as a surfactant in at least one of its hydrophilic layers. The gelatin binder of the silver halide photographic industrial X-ray element in accordance with this invention can be hardened with appropriate hardening agents such as those of the epoxide type, those of the ethylenimine type, chromium salts e.g. chromium acetate and chromium alum, aldehydes e.g. formaldehyde, glyoxal, and gluta-raldehyde, N-methylol compounds e.g. dimethylolurea and methyloldi-methylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts. According to this invention especially formaldehyde is preferred. The hardening agent may be added to the coating composition of the emulsion layer(s) and/or to the coating composition of the protective antistress layer(s) before or during the coating procedure. If the hardener is added during the coating procedure it is still possible to make corrections for the water absorption of the material that still has to be coated, by controlling the amount of water absorption for the already coated material directly after coating.

Hardening is preferably provided to such an extent that, when the photographic material is rinsed at the end of the processing cycle just before drying, an amount of less than 2.5 grams of water per gram of coated gelatin is absorbed.

In the preferred embodiment according with this invention polyoxyalkylene surfactant compounds are simultaneously present so that the "pi-line" defect disappears to an acceptable level for materials with such a high silver content as silver halide industrial X-ray photographic films. For industrial radiography the silver halide emulsion layer(s) e.g. comprise total amounts of silver halide, coated per side and per square meter of from 6 to 20 g, expressed as the equivalent amounts of silver nitrate. Said total amounts evidently promote the appearance of the "pi-line" defect defined hereinbefore.

A preferred polyoxyalkylene compound according to this invention is the condensation product of castor oil and polyethylene oxide with about 40 recurrent units, the formula (I.1) of which is given hereinafter. The said polyoxyalkylene compound(s) is(are) preferably present in an amount between 10 to 200 mg per square meter and per side of the film support and still more preferably in an amount between 20 to 100 mg per square meter and per side of the film support. Preferred compounds of this type are $$R\text{-}COO\text{-}(CH_2\text{-}CH_2\text{-}O)_{40}\text{-}H \text{ wherein R=castor oil residue} \quad (I.1)$$

$$C_9H_{19}\text{-Phenyl-O-}(CH_2\text{-}CH_2\text{-}O)_n\text{-}H \quad (I.2)$$

$$H\text{-}(O\text{-}CH_2\text{-}CH_2)_n\text{-}O\text{-}(CH_2)_8\text{-}CH{=}CH\text{-}C_8H_{17} \quad (I.3)$$

$$C(CH_3)_3\text{-}CH_2\text{-}C(CH_3)_2\text{-Phenyl-O-}(CH_2\text{-}CH_2\text{-}O)_{n\text{-}H} \quad (I.4)$$

Compounds (I.1) to (I.4) preferably have molecular weights from 300 to about 4000.

Both the alkyleneoxide polymer(s) and the hardener(s) described hereinbefore are preferably present in at least one of the non light-sensitive layers and more preferably both compounds are added to the protective antistress layer which is preferably present as an outermost layer at both sides of the support.

Light-sensitive layers of the silver halide industrial photographic X-ray material according to this invention comprise the silver halide emulsions. In accordance with this invention the silver halide emulsions coated in the silver halide emulsion layer(s) may comprise silver chloride, silver chlorobromide, silver chlorobromoiodide, silver bromide and silver bromoiodide. Suitable silver chloride and silver chlorobromide emulsions have e.g. been described in EP-Application No. 91202761.2, filed Oct. 24, 1991.

The said silver halide emulsions coated in the silver halide emulsion layer(s) may comprise silver bromoiodide crystals with at most 10 mole % of iodide, preferably at most 3 mole % and still more preferably 1 mole %. It is preferred to use regular-shaped silver halide crystals and more particularly silver bromoiodide emulsions with cubic crystal habit which are commonly used in industrial radiographic materials and are known to have good development characteristics with respect to high sensitivity. During the precipitation stage of the emulsion making the parameter determining whether cubic or octahedral crystals are formed is the pAg of the solution.

The pAg of the solution may be regulated by any of the means known in the art of emulsion making, such as the electronic control apparatus and method disclosed in U.S. Pat. No. 3,821,002.

From the article "Der Einfluß der Wachstumsbedingungen auf die Kristalltracht der Silberhalogenide" (the influence of Growth Conditions on the Crystalline Behaviour of Silver halides) yon E.Moisar and E.Klein, Bunsengesellschaft fur physikalische Chemie, Berichte 67 949–957 (1963) No 9.10., it is known that on allowing tetradecahedral crystals of a homodisperse silver bromide emulsion to grow by controlled addition of solutions of silver nitrate and potassium bromide, crystals of cubic form are obtained under conditions of low excess bromide concentration in the solution phase. A preferred embodiment of making the emulsions used according to the present invention involves the preparation of high-sensitive silver bromoiodide emulsions as these X-ray emulsions, by precipitation under double jet conditions. Although nowadays processes for the preparation of homogeneous silver halide emulsions make use of special control devices to regulate the form of the resulting silver halide crystals, said form mainly being determined by the pAg value and temperature in the reaction vessel, the silver ion concentration can be kept constant during the precipitation by the use of a special inlet technique as described in Research Disclosure 10308.

The average grain-size of the silver halide emulsions made according to the present invention is preferably situated between 0.1 and 1.0 μm. Particle size of silver halide grains can be determined using conventional techniques e.g. as described by Trivelli and M.Smith, The Photographic Journal, vol. 69, 1939, p. 330–338, Loveland "ASTM symposium on light microscopy" 1953, p. 94–122 and Mees and James "The Theory of the photographic process" (1977), Chapter II.

To obtain a reproducible crystal size especially the flow rate and concentration of the solutions, the temperature and pAg have to be adjusted very carefully. Grain-growth restrainers or accelerators may be added from the start or during the preparation of the emulsion crystals. Depending on the initial conditions during precipitation, monodispersed emulsions can be prepared as is preferred for this invention. Monodispersed emulsions in contrast to heterodispersed emulsions have been characterized in the art as emulsions of which at least 95% by weight or number of the grains have a diameter which is within about 40%, preferably within about 30% of the mean grain-diameter and more preferably within about 10% to 20%.

Silver halide grains having a very narrow grain-size distribution can thus be obtained by strictly controlling the conditions at which the silver halide grains are prepared using a double jet procedure. In such a procedure, the silver halide grains are prepared by simultaneously running an aqueous solution of a water-soluble silver salt for example, silver nitrate, and water-soluble halide, for example, a mixture of potassium bromide and potassium iodide, into a rapidly agitated aqueous solution of a silver halide peptizer, preferably gelatin, a gelatin derivative or some other protein peptizer. Even colloidal silica may be used as a protective colloid as has been described in EP Application 392,092.

In a preferred embodiment the rates of addition of the silver nitrate and halide salt solutions are steadily increased in such a way that no renucleation appears in the reaction vessel. This procedure is especially recommended, not only to save time but also to avoid physical ripening of the silver halide crystals during precipitation, the so-called Ostwald ripening phenomenon, which gives rise to the broadening of the silver halide crystal distribution.

Once the grains have reached their ultimate size and shape, the emulsions are generally washed to remove the by-products of grain-formation and grain-growth. In order to remove the excess of soluble salts washing is applied at a pH value which can vary during washing but remains comprised between 3.7 and 3.0 making use of a flocculating agent like polystyrene sulphonic acid. The emulsion may be washed by diafiltration by means of a semipermeable membrane, also called ultrafiltration, so that it is not necessary to use polymeric flocculating agents that may disturb the coating composition stability before, during or after the coating procedure. Such procedures are disclosed e.g. in Research Disclosure Vol. 102, Oct. 1972, Item 10208, Research Disclosure Vol. 131, March, Item 13122 and Mignot U.S. Pat. No. 4,334,012. Preferably, at the start of the ultrafiltration, there is no pH and pAg adjustment as pH and pAg are maintained at the same level as at the end of the preceding precipitation without any adjustment stage.

In accordance with the present invention, the emulsions are preferably washed by acid-coagulation techniques using acid-coagulable gelatin derivatives or anionic polymeric compounds or, when precipitation occurred in silica medium, by certain polymers capable of forming hydrogen bridges with silica, in an amount sufficient to form coagulable aggregates with the silica particles as has been described in EP Application 517 961.

Coagulation techniques using acid-coagulable gelatin derivatives have been described e.g. in U.S. patent specification Nos. 2,614,928, 2,614,929 and 2,728,662. The acid-coagulsble gelatin derivatives are reaction products of gelatin with organic carboxylic or sulphonic acid chlorides, carboxylic acid anhydrides, aromatic isocyanates or 1,4-diketones. The use of these acid-coagulable gelatin derivatives generally comprises precipitating the silver halide grains in an aqueous solution of the acid coagulable gelatin derivative or in an aqueous solution of gelatin to which an acid coagulable gelatin derivative has been added in sufficient proportion to impart acidcoagulable properties to the entire mass. Alternatively, the gelatin derivative may be added after the stage of emulsification in normal gelatin, and even after the physical ripening stage, provided it is added in an amount sufficient to render the whole coagulable under acid conditions. Examples of acid-coagulable gelatin derivatives suitable for use in accordance with the present invention can be found e.g. in the United States Patent Specifications referred to above. Particularly suitable are phthaloyl gelatin and N-phenylcarbamoyl gelatin.

The coagulum formed may be removed from the liquid by any suitable means, for example the supernatant liquid is decanted or removed by means of a siphon, where upon the coagulum is washed out once or several times.

Washing of the coagulummay occur by rinsing with mere cold water. However, the first wash water is preferably acidified to lower the pH of the water to the pH of the coagulation point. Artionic polymer e.g. polystyrene sulphonic acid may be added to the wash water even when an acid coagulable gelatin derivative has been used e.g. as described in published German Patent specification (DOS) 2,337,172 mentioned hereinbefore. Alternatively washing may be effected by redispersing the coagulum in water at elevated temperature using a small amount of alkali, e.g. sodium or ammonium hydroxide, recoagulating by addition of an acid to reduce the pH to the coagulation point and subsequently removing the supernatant liquid. This redispersion and recoagulation operation may be repeated as many times as is necessary.

After the washing operation, the coagulum is redispersed to form a photographic emulsion suitable for the subsequent finishing and coating operations by treating, preferably at a temperature within the range of 35° to 70° C., with the required quantity of water, gelatin and, if necessary, alkali for a time sufficient to effect a complete redispersal of the coagulum.

Instead or in addition to normal gelatin, which is preferably used, other known photographic hydrophilic colloids can also be used for redispersion e.g. a gelatin derivative as referred to above, albumin, agar-agar, sodium alginate, hydrolysed cellulose esters, polyvinyl alcohol, hydrophilic polyvinyl copolymers, colloidal silica etc.

The light-sensitive silver bromohalide emulsions are chemically sensitized with a sulphur and gold sensitizer. This can be done as described i.a. in "Chimie et Physique Photographique" by P. Glafkides, in "Photographic Emulsion Chemistry" by G.F. Duffin, in "Making and Coating Photographic Emulsion" by V.L. Zelikman et al, and in "Die Grundlagen der Photographischen Prozesse mit Silberhalogeniden"edited by H. Frieser and published by Akademische Verlagsgesellschaft (1968). As described in said literature sulphur sensitization can be carried out by effecting the ripening in the presence of small amounts of compounds containing sulphur e.g. thiosulphate, thiocyanate, thioureas, sulphites, mercapto compounds, and rhodamines. Gold sensitization occurs by means of gold compounds. In addition small amounts of compounds of Ir, Rh, Ru, Pb, Cd, Hg, Tl, Pd or Pt can be used. The emulsion can be sensitized in addition by means of reductors e.g. tin compounds as described in GB-A 789,823, amines, hydrazine derivatives, formamidine-sulphinic acids, and silane compounds.

If more than one silver bromohalide emulsion is used in one or more emulsion layers, the said bromohalide emulsions are chemically ripened separately.

As has been set forth in EP-Application No. 92200420.5 filed on Feb. 14, 1992 the image tone can be improved by making mixtures of chemically ripened cubic monodisperse silver bromoiodide crystals and chemically ripened cubic monodisperse silver chloride and/or silver chlorobromide and/or silver chlorobromoiodide emulsion crystals, wherein the added non-silverbriomoiodide crystals have also been ripened separately.

In accordance with the present invention compounds for preventing the formation of fog or stabilizing the photographic characteristics during the production or storage of photographic elements or during the photographic treatment thereof may be supplementary added. Examples of such stabilizers are heterocyclic nitrogen-containing stabilizing compounds as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, tri-azolopyrimidines such as those described in GB-A 1,203,757, GB-A 1,209,146, JA-Appl.75-39537, and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid, benzenethiosulphonic acid amide and other disulfide derivatives, which are giving an unsatisfactory result if added as the sole stabilizing agent and are therefore combined with other stabilizers belonging to the classes of stabilizers already mentioned. On the other hand mercury salts and other metal-salts that can be used as fog-inhibiting compounds such as cadmium salts and related compounds described in Research Disclosure N° 17643 (1978), Chapter VI, should be avoided for reasons of ecology.

The weight ratio of gelatin to silver halide (expressed as silver nitrate) in the silver halide emulsion layers of the photographic material according to the present invention is generally comprised between 0.3 and 1.2, preferably between 0.6 and 1.1.

For industrial radiography the silver halide emulsion layer(s) comprise total amounts of silver halide, coated per side and per square meter corresponding to from 6 to 20 g, expressed as the equivalent amounts of silver nitrate.

The photographic elements under consideration may further comprise various kinds of surface-active agents in the photographic emulsion layer and/or in at least one other hydrophilic colloid layer. Preferred surface-active coating agents are compounds containing perfluorinated alkyl groups. Other suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, siliconepolyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration.

Development acceleration can be accomplished with the aid of various compounds, preferably polyalkylene derivatives having a molecular weight of at least 400 such as those described in e.g. U.S. patent application Nos. 3,038,805, 4,038,075 and 4,292,400.

The photographic elements may further comprise various other additives such as e.g. compounds improving the dimensional stability of the photographic element, UV-absorbers, spacing agents and plasticizers.

Suitable additives for improving the dimensional stability of the photographic element are i.a. dispersions of a water-soluble or hardly soluble synthetic polymer e.g. polymers of alkyl (meth) acrylates, alkoxy(meth) acrylates, glycidyl (meth)acrylates, (meth) acrylamides, vinyl esters, acrylonitriles, olefins , and styrenes, or copolymers of the above with acrylic acids, methacrylic acids, Alpha-Beta-unsaturated dicarboxylic acids, hydroxyalkyl (meth) acrylates, sulphoalkyl (meth) acrylates, and styrene sulphonic acids.

Suitable UV-absorbers are i.a. aryl-substituted benzotriazole compounds as described in U.S. patent application No. 3,533,794, 4-thiazolidone compounds as described in U.S. patent application Nos. 3,314,794 and 3,352,681, benzophenone compounds as described in JP-A 2784/71, cinnamic ester compounds as described in U.S. patent application Nos. 3,705,805 and 3,707,375, butadiene compounds as described in U.S. patent application No. 4,045,229, and benzoxazole compounds as described in U.S. patent application No. 3,700,455.

In general, the average particle size of spacing agents is comprised between 0.2 and 10 μm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. patent application No. 4,614,708.

The photographic element can comprise an antistatic layer e.g. to avoid static discharges during coating, processing and other handlings of the material. Such antistatic layer can be an outermost coating or stratum of one or more antistatic agents or a coating applied directly to the film support. Said antistatic layer(s) may be overcoated with a barrier layer of e.g. gelatin. Antistatic compounds suitable for use in such layers are e.g. vanadium pentoxide sols, tin oxide sols or conductive polymers such as polyethylene oxides, polymer latices and the like.

The photographic material according to the present invention is preferably a duplitized material having on both sides of the film support at least one emulsion layer and at least one protective antistress layer. The said emulsion layers are preferably overcoated with one protective antistress topcoat layer, the cross-linkable binder of said topcoat layer being hardened with a non-vinyl sulphonyl type hardener and more preferably with formaldehyde according to this invention as described hereinbefore. Preferably said protective antistress topcoat layer comprises at least one alkylenoxide polymer as a surfactant.

The support of the photographic material in accordance with the present invention may be a transparent resin, preferably a blue coloured polyester support like polyethylene terephtalate. The thickness of such organic resin film is preferably about 175 μm. The support is provided with a substrate layer at both sides to have good adhesion properties between the emulsion layer and said support.

A further fine-tuning of the outlook of the film may be required. Therefore the absorption spectrum of the material as obtained after the processing cycle described hereinafter may be obtained by the addition of suitable non-migratory dyes to the subbing layer, the emulsion layer(s) or the protective antistress layer(s) or to the topcoat layer at both sides of the support. A blue coloured dye is therefore especially recommended.

The photographic industrial X-ray material can be imagewise exposed by means of an X-ray radiation source the energy of which, expressed in kV, depends on the specific application. Another typical radiation source is a radioactive $Co^{60}$ source. To reduce the effect of scattering radiation a metal screen, usually a lead screen, is used in combination with the photographic film. Besides the generation of secondary electrons makes the sensitivity to enhance.

A further measure to make the "pi-line" defect disappear consists in processing of the described materials in automatical processing machines wherein the developer solution comprises as a surfactant at least one anionic alkyl-phenoxy and/or alkoxy polyalkyleneoxy phosphate ester (compounds II.1 and II.2), sulphate ester (compound II.3), alkyl carboxylic, sulphonic or phosphonic acid (compounds II.4, II.5 and II.6 respectively).

$$R\text{-}O\text{-}(CH_2\text{-}CH_2\text{-}O)_n\text{-}PO(OH)_2 \quad (II.1)$$

$$\begin{array}{l} R_1-O-(CH_2-CH_2-O)_n \\ \qquad\qquad\qquad\qquad \diagdown \\ \qquad\qquad\qquad\qquad\quad PO(OH) \\ \qquad\qquad\qquad\qquad \diagup \\ R_2-O-(CH_2-CH_2-O)_n \end{array} \quad (II.2)$$

$$R\text{-}O\text{-}(CH_2\text{-}CH_2\text{-}O)_n\text{-}SO_3H \quad (11.3)$$

$$R\text{-}O\text{-}(CH_2\text{-}CH_2\text{-}O)_m\text{-}CH_2\text{-}CH_2\text{-}COOH \quad (II.4)$$

$$R\text{-}O\text{-}(CH_2\text{-}CH_2\text{-}O)_m\text{-}CH_2\text{-}CH_2\text{-}SO_3H \quad (II.5)$$

$$R\text{-}O\text{-}(CH_2\text{-}CH_2\text{-}O)_m\text{-}CH_2\text{-}CH_2\text{-}PO(OH)_2 \quad (II.6)$$

wherein R, $R_1$ and $R_2$ independently represent a substituted or unsubstituted alkyl-group or $R_3$-Phenyl or $R_4$-Phenyl and wherein each of $R_3$ and $R_4$ independently represent an alkyl group, preferably $C_8$-$C_{20}$ alkyl, m and n are integers from about 3, respectively 4, to about 30.

Preferably the said at least one anionic alkylphenoxy polyalkyleneoxy phosphate ester surfactant present in the developer solution is an alkyl-phenoxy-(ethyleneoxy) n phosphoric acid mono- or di-ester compound or a mixture thereof (see compounds (II.1) and (II.2)) in their salt form, wherein n is a positive integer of at least 4 and the alkyl group is a $C_8$ to $C_{20}$ alkyl group.

Preferred amounts of the said at least one ionic surfactant present in the developer are from about 25 to 200 mg/l.

A further improvement can be obtained by the presence in the fixer of at least one alpha-ketocarboxylic acid, e.g. oxalic acid or glyoxalic acid or pyruvic acid. The alpha-ketocarboxylic acid may be present in an amount of about 1 to 2 g/l.

In a preferred embodiment about 1 to 2 g/l of oxalic acid as the cheapest compound is added to the fixer solution when the said solution contains aluminum salt(s) as hardening agent(s).

The processing of the exposed materials in accordance with this invention, characterised by the steps of developing and fixing respectively with the developer and fixing solutions containing the particularly required compounds in accordance with this invention as described hereinbefore may be performed with hardener-containing processing solutions.

The developer solution according to the invention has further to be replenished not only for decrease of the liquid volume due to cross-over into the next processing solution but also for pH-changes due to oxidation of the developer molecules. This can be done on a regular time interval basis or on the basis of the amount of processed film or on a combination of both. The development step can be followed by a washing step, is further followed by a fixing solution and further by another washing or stabilization step. Finally after the last washing step the photographic material is dried by means of infrared drying means, by means of convection or by a combination of both.

In accordance with this invention a quite satisfying improvement is observed in the physical characteristics of the film surface as the "pi-line" defect disappears, partially due to additions to the coating solutions before coating the layers of the photographic material, partially to compounds added to the developer solution and to compounds added to the fixer solution.

As a consequence extra physical means as e.g. brush rollers present in the processor (like hitherto for the STRUCTURIX NDT-3 machine, trade name marketed by Agfa-Gevaert and for the EK-Mod. B, trade name marketed by Eastman Kodak) after the rinsing unit following fixation may be omitted. For the customer this leads to a lower cost price as he also needs less support.

Of course processing conditions and composition of processing solutions are dependent from the specific type of photographic material. For example, according to this invention for materials for industrial X-ray diagnostic purposes an automatically operating processing apparatus is used provided with a system for automatic regeneration of the processing solutions. Applications within total processing times of 90 seconds are possible. From an ecological point of view it is even possible to use sodium thiosulphate instead of ammonium thiosulphate in the fixer.

It is clear that the improvements stated for industrial X-ray films will also apply to X-ray medical films of high silver halide content.

The following examples illustrate the invention without however limiting it thereto.

EXAMPLES

Example No. 1

A gelatino silver iodobromide X-ray emulsion comprising 99 mole of silver bromide and 1 mole % of silver iodide was prepared in the following way. An aqueous solution containing 3 grams of ammonia was added to the reaction vessel containing 1550 ml of a 3% by weight aqueous solution of gelatin at 45° C. Into said reaction vessel a solution of 2000 ml of an aqueous 1.5 molar solution of potassium bromide and a solution of 2000 ml of an aqueous 1.5 molar solution of silver nitrate were introduced at constant rate of 86 ml/min under vigorously stirring conditions. During precipitation the pAg value was adjusted to and maintained at a value corresponding to an E.M.F. of +20 mV with reference to a silver/saturated calomel electrode. In this way homogeneous and regular silver halide grains having a crystal diameter of 0.54 μm were obtained.

At the end of the precipitation step, the emulsion was coagulated by adding polystyrene sulphonic acid acting as a flocculating agent after adjustment of the pH value of the emulsion in the reaction vessel to 3.5 with sulphuric acid. After rapid sedimentation of said silver halide emulsion the supernatant liquid was decanted. To remove the water-soluble salts from said flocculate, demineralized water of 11° C. was added under controlled stirring conditions followed by a further sedimentation and decantation. This washing procedure was repeated until the emulsion was sufficiently desalted. Thereafter the coagulum was redispersed at 45° C. in water after the addition of a sufficient amount of gelatin to obtain a ratio of gelatin to silver halide expressed as silver nitrate of 0.4. The pH-value was adjusted to 6.5 and pAg to a value of +70 mV with reference to the silver/saturated calomel electrode.

Chemical sensitization of said emulsion was performed by the addition of a sulphur and gold sensitizer and digestion at 50° C. to the point where the highest sensitivity was reached for a still acceptable fog level.

This emulsion was coated at both sides of a blue polyethylene terephtalate support having a thickness of 175 μm, so that per sq. m. an amount of silver halide corresponding to 14.5 g of silver nitrate and 12.3 g of gelatin were present. Before coating stabilizers such as 5-methyl-7-hydroxy-5-triazolo-[1,5-a]-pyrimidin and 1-phenyl-5-mercaptotetrazol were added to the emulsion. From a number of samples of the materials thus formed, the emulsion layers were covered at both sides with a protective layer of 1.5 grams of gelatin per square meter, which were hardened with 0.066 g of formaldehyd (FMD) per square meter for the materials Nos. 1 and 2 The protective layers of material No. 2 were in addition coated with a polyoxyalkylene compound (indicated as POAC in the Table 1) corresponding to the formula (I.1) in an amount of 0.042g/m$^2$ at both sides of the film.

The coated and dried films were exposed according to ISO 7004 with a 235 kV radiation source with a copper filter of 8 mm thickness.

The exposed radiographic films were developed, fixed, rinsed and dried in an automatic machine processing cycle of 8 minutes.

Development occurred in developer G135 (trade name) marketed by Agfa-Gevaert, at 28° C. further called DEV, which comprised hydroquinone, phenidone, potassium sulphite, 1-phenyl-5-mercaptotetrazole, 5-nitroindazole and glutaric dialdehyde. Fixing occurred in fixer G335 (trade name) marketed by Agfa-Gevaert, at 28° C., hereinafter called FIX, which comprised aluminum sulphate, sodium sulphite, boric acid and sodium acetate. In addition, if according to this invention compound (II.1) was added to the developer as an anionic alkylphenoxy polyalkyleneoxy phosphate ester surfactant, in an amount of 100 mg/liter, said developer was called DEVPHOS. Besides, if according to this invention oxalic acid was added to the fixer as an alpha-ketocarboxylic acid in an amount of 1.4 g/liter, said fixer was called FIXOX.

In Table 1 hereinafter the combinations are summarized of developers and fixers wherein the materials Nos. 1 and 2, exposed as described hereinbefore, were run.

To simulate severe real circumstances that might initiate piline defects processing of the materials was performed as follows:

an amount of film was exposed to such an extent as to have a moderate density corresponding to the practically obtained average density for real samples after processing. The said amount of film was run through the processor to cause a replenishment of the processing solutions so that the said processing solutions were totally regenerated. In praxis about-10 m$^2$ per day were run through the said processing solutions and the applied regeneration was 900 ml/m$^2$ for the developer and 1200 ml/m$^2$ for the fixer. For every experimental combination of film and processing solutions as summarized in Table 1, this procedure was started up again to reach good working conditions wherein pi-line defects could be evaluated.

Therefor after the said working conditions were reached unexposed sheets of the different materials were run through the processor. The first ten sheets of each material were examined superposed to make an objective evaluation possible.

FIGURES ranging from 0 to 6 were given with the following significance for the appearance of the pi-line defect:

6: inadmissable 4 or 5: admissable for non-critical users who are not informed about the appearance of the defect.

2 or 3: acceptable for users who have already been confronted with the failure.

1: acceptable for critical customers

0: no visibly detectable pi-line defect

In Table 1 these figures are corresponding with the comments just given hereinbefore.

TABLE 1

| Material No. | Developer | Fixer | Pi-line defect | Exp. |
|---|---|---|---|---|
| 1 FMD | DEV | FIX | 6 | 1 |
| 2 FMD/POAC | DEV | FIX | 3 | 2 |
| 1 FMD | DEVPHOS | FIX | 3 | 3 |
| 1 FMD | DEVPHOS | FIXOX | 2 | 4 |
| 2 FMD/POAC | DEVPHOS | FIX | 1 | 5 |
| 2 FMD/POAC | DEVPHOS | FIXOX | 0 | 6 |

As can be seen from Table 1 the pi-line defect can already be improved by the addition of a polyoxyalkylene compound to the protective antistress layer. An improved effect to about an equal level is reached when the material No. 1 is developed in a developer containing a phosphate ester surfactant, eventually combined with a fixer containing oxalic acid (experiments Nos. 3 and 4). The improvement becomes still more remarkable when material No. 2 is developed in a developer containing a phosphate ester surfactant combined with a fixer containing oxalic acid (experiments Nos. 5 and 6).

One may conclude that it is possible to reach a defect free result with the formaldehyd hardened film material containing a polyoxyalkylene compound in its protective antistress layer, provided that a phosphor ester surfactant is added to the developer and oxalic acid to the fixer.

We claim:

1. Method of image formation in a silver halide industrial X-ray photographic material, comprising on at least one side of a support, at least one gelatino silver bromide or bromoiodide emulsion layer and a total amount of silver halide, corresponding to from 6 to 20 g of silver nitrate per square meter and per side, and at least one non-sensitive protective antistress coating by the steps of exposing said material to direct X-rays and processing the material in an automatic processing machine by development, fixing, rinsing and drying, characterized in that said material further comprises at least one hardening agent different from a vinyl sulphone compound and at least one polyoxyalkylene compound, said at least one polyalkylene compound being the condensation product of castor oil add polyethylene oxide with 40 recurrent units, in at least one of its hydrophilic layers, and that development occurs in a developer comprising as a surfactant at least one anionic alkylphenoxy and/or alkoxy polyalkyleneoxy phosphate ester, sulphate ester, alkyl carboxylic, sulphonic or phosphonic acid and/or a salt thereof.

2. Method of image formation according to claim 1, wherein in said silver halide industrial photographic X-ray material the said hardening agent is formaldehyde.

3. Method of image forming according to claim 1, wherein said polyoxyalkylene compound(s) is(are) present in an amount between 10 to 200 mg/m$^2$ per side of the film support.

4. Method of image forming according to claim 1, wherein said polyoxyalkylene compound(s) is(are) present in an amount between 20 to 100 mg/m$^2$ per side of the film support.

5. Method of image formation according to claim 1, wherein said polyoxyalkylene compound(s) and/or said hardening agent(s) are present in said protective antistress coating(s).

6. Method of image formation according to claim 1, wherein the said anionic alkylphenoxy polyalkyleneoxy phosphate ester surfactant in the developer is an alkylphenoxy-(ethyleneoxy)$_n$ phosphoric acid mono- or di-ester compound in its salt form, wherein n is a positive integer of at least 4 and the alkyl group is a $C_8$ to $C_{20}$ alkyl group.

7. Method of image formation according to claim 7, wherein the said anionic alkylphenoxy polyalkyleneoxy phosphate ester surfactant is present in the developer in an amount of 25 to 200 mg/l.

8. Method of image formation according to claim 1, wherein the fixer contains at least one alpha-ketocarboxylic acid.

9. Method of image formation according to claim 8, wherein the said alpha-ketocarboxylic acid is oxalic acid or glyoxalic acid or pyruvic acid.

10. Method of image formation according to claim 8 wherein the said alpha-ketocarboxylic acid is present in the fixer in an amount of 1 to 2 g/l.

* * * * *